United States Patent [19]

McMahon

[11] Patent Number: 4,738,215

[45] Date of Patent: Apr. 19, 1988

[54] BUMPER CONSTRUCTION FOR PONTOON BOATS

[75] Inventor: Terry L. McMahon, Lebanon

[73] Assignee: Tracker Marine Corporation, Springfield, Mo.

[21] Appl. No.: 908,293

[22] Filed: Sep. 17, 1986

[51] Int. Cl.[4] ..... B63B 59/02

[52] U.S. Cl. ..... 114/219; 114/61

[58] Field of Search ..... 114/61, 219, 266, 343, 114/361, 292

[56] References Cited

U.S. PATENT DOCUMENTS 1,731,492 10/1929 Haase ..... 114/219

3,261,320 7/1966 Leonard ..... 114/219

FOREIGN PATENT DOCUMENTS 505852 5/1939 United Kingdom ..... 114/219

*Primary Examiner*—Joseph F. Peters, Jr.

*Assistant Examiner*—Jesûs D. Sotelo

*Attorney, Agent, or Firm*—Kokjer, Kircher, Bradley, Wharton, Bowman & Johnson

[57] ABSTRACT

A bumper for protecting the tapered nose cones on the forward ends of the pontoons of a pontoon boat. Each bumper has opposite sides which converge at their forward ends and carry a padded nose piece which accepts impacts that would otherwise be applied to the sharp tip of the pontoon. Each bumper also provides a carpeted step for receiving the feet of persons boarding or unboarding the boat.

12 Claims, 1 Drawing Sheet

BUMPER CONSTRUCTION FOR PONTOON BOATS

BACKGROUND AND SUMMARY OF THE INVENTION

This invention relates generally to boating equipment and more particularly to a bumper construction for the pontoons of pontoon boats.

Pontoon boats are commonly used in fishing, water skiing and other boating activities. The pontoons typically terminate in nose cones at their forward ends. During docking and other maneuvering of the boat, the nose cones are subject to being damaged as a result of impacts with docks, other boats and various other structures. The sharp nose cone can also cause significant damage to the structures it may contact.

The present invention is directed to a pontoon boat that is equipped with special bumpers which protect the pontoons from damage caused by impacts applied to the nose cones. The bumpers additionally prevent the nose cones from damaging other boats, docks and other objects during docking and maneuvering of the boat in tight spaces. It is an important feature of the invention that each bumper also presents a horizontal step that is conveniently located to receive that feet of persons boarding or unboarding the boat. The bumpers are provided with cleats which permit boarding ladders, anchors and other hardware items to be attached to the pontoons. The bumpers are attached to the pontoons in a secure manner and are constructed to prevent waves from breaking over the forward edge of the boat deck when rough water is encountered. The construction and configuration of the bumpers gives them an attractive appearance that blends well with the remainder of the boat.

DETAILED DESCRIPTION OF THE INVENTION

In the accompanying drawing which forms a part of the specification and is to be read in conjunction therewith and in which like reference numerals are used to indicate like parts in the various views.

Figure 2:
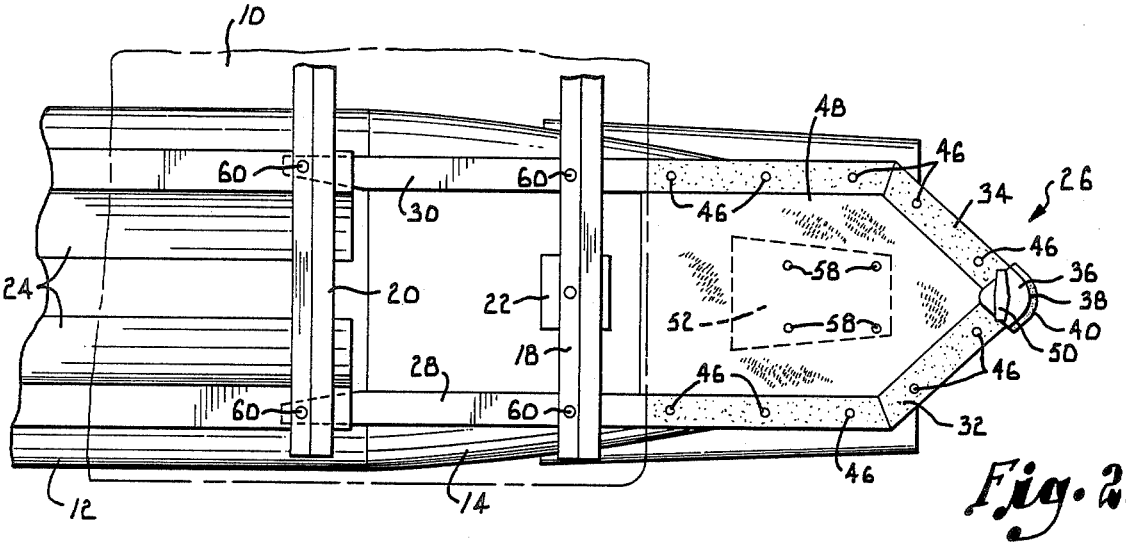
FIG. 2 is a top plan view showing the bumper installed on the pontoon, with the body of the boat shown fragmentarily in phantom lines.
Figure 3:
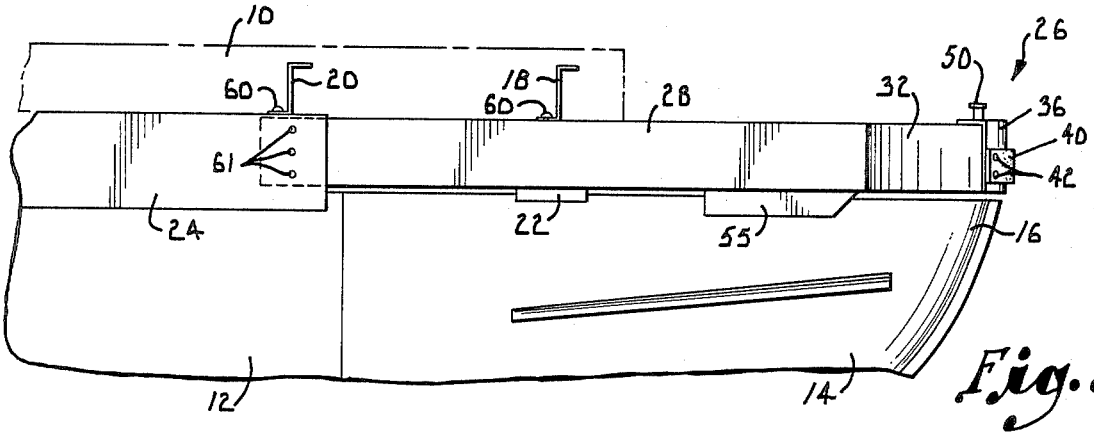
FIG. 3 is a side elevational view showing the bumper installed on the pontoon, with the body of the boat shown fragmentarily in broken lines.

Referring now to the drawing in more detail, a pontoon boat conventionally includes a body 10 which is shown fragmentarily in phantom lines in FIGS. 2 and 3 and which is equipped with a pair of generally cylindrical pontoons 12 (only one of which is shown in the drawing). The forward end of each pontoon 12 includes a nose cone 14 which tapers as it extends forwardly to terminate in a sharp forward tip 16. The nose cones 14 can be secured on the pontoons 12 in any suitable manner.

The body 10 of the pontoon boat is secured to the pontoons 12 by means of a pair of lateral braces 18 and 20 mounted on each pontoon. Each brace 18 and 20 is Z shaped in section. The lower flange of the forward brace 18 is bolted or otherwise secured on top of a mounting bracket 22 which is welded to the top of the nose cone 14. The rear brace 20 has its lower flange bolted or otherwise secured to a pair of channel members 24 which are secured on top of the pontoon 12. Each of the members 24 has the general shape of an inverted U, and members 24 extend parallel to one another and to the fore and aft axis of the boat 10. The boat body 10 is suitably secured to the braces 18 and 20.

The pontoon boat is typically a sports boat, although the bumper of the present invention can be used with virtually any type of pontoon boat. The details of construction of the boat are not important to the present invention and will not be further described.

In accordance with the present invention, each pontoon 12 is equipped with a bumper which is generally identified by reference numeral 26. Each bumper 26 has a pair of sides 28 and 30 which are both preferably formed by angle members. Converging side portions 32 and 34 extend from the forward ends of the respective sides 28 and 30. Preferably, the converging portions 32 and 34 are integral with the parallel sides 28 and 30 and are bent inwardly such that they converge and meet at their forward ends. Side portions 32 and 34 are preferably angle members. The horizontal flanges of the angle members may be provided with horizontal corrugations (not shown).

As previously indicated, side portions 32 and 34 converge at their forward ends. A rigid nose member 36 is located at the intersection between the side portions 32 and 34 and is welded or otherwise suitably secured to the end of each side member. The nose piece 36 has a curved surface 38 which faces forwardly and which is provided with a soft pad 40. The pad 40 may be neoprene rubber or another soft material having the ability to cushion impacts applied to the bumper. Screws 42 or other fasteners are used to secure pad 40 on the nose piece 36.

Figure 1:
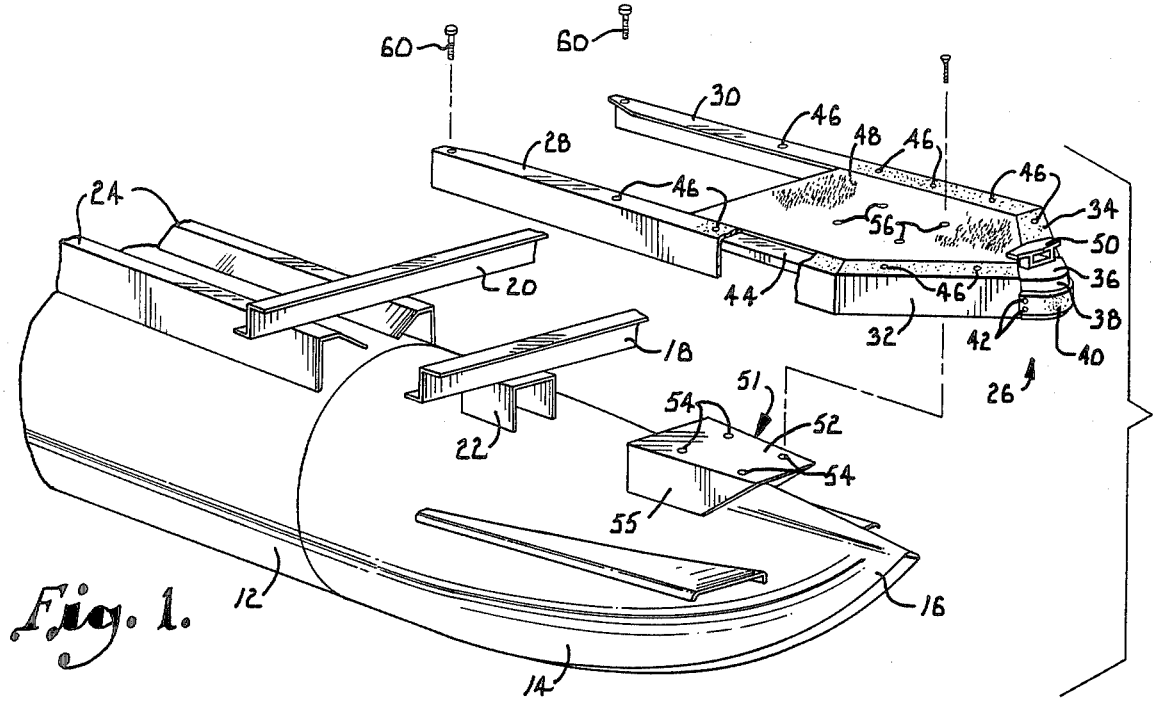
FIG. 1 is an exploded perspective view showing the forward end of a pontoon and a bumper constructed according to the present invention, with a portion broken away for purposes of illustration.

Each bumper 26 is provided with a step 44 (FIG. 1) which may be formed from a piece of plywood or another suitable material. The step 44 is cut in a shape to underlie the horizontal flanges of the side members 28, 30, 32 and 34. Screws 46 are used to fasten the step 44 to each of the side members 28–34 such that the edges of the step are covered by the angle members which form the sides of the bumper. In this manner, the sides serve as trim for the step and enhance its appearance by covering its edges. The upper surface of the step 44 has a horizontal orientation and is large enough to receive the feet of persons boarding and unboarding the boat. Preferably, carpet 48 is applied to the top surface of the step 44.

A cleat 50 is mounted on top of the nose piece 46 at the nose of the bumper 26. Cleat 50 permits lines and various hardware items to be attached to the bumper, as will be explained more fully.

Mounted on top of the nose cone 14 of the pontoon is a bracket 51 to which step 44 is secured. The mounting bracket 51 includes a horizontal plate 52 provided with bolt holes 54, and it also includes substantially vertical sides 55 which are welded at their lower edges to the nose cone 14. Plate 52 is elevated above the pontoon 12. Step 44 is provided with a plurality of bolt holes 56 having a pattern which matches the pattern of the bolt holes 54 in the mounting platform 52. Bolts 58 are used to secure step 44 on top of the mounting plate or platform 52.

Each bumper 26 is installed on the corresponding pontoon 12 by applying step 44 to the mounting platform 52. The sides 28 and 30 of the bumper are extended beneath the lower flanges of braces 18 and 20 with the angle cut back end portion of each side 28 and 30 fitting in the open forward end of one of the channels 24. Bolts 60 are extended through the lower flanges of braces 18 and 20 and through sides 28 and 30 in order to rigidly secure the bumper 26 to the frame of the boat. Rivets 61 are secured to the side flanges of channels 24 and sides 28 and 30 in order to enchance the security of the connections. The fit of sides 28 and 30 in channels 24 provides additional security in the mounting of the bumper. The bolts 58 are extended through the bolt holes 56 and 54 in order to secure step 44 to the mounting platform 52. The upper surfaces of sides 28 and 30 are preferably non-skid surfaces.

When each bumper 26 has been installed on the pontoon in this manner, the nose piece 36 is located immediately above the sharp tip 16 of the nose cone 14. The soft pad 40 projects forwardly beyond tip 16 and thus receives impacts that would otherwise be applied to the tip 16. Consequently, during docking and other maneuvering of the boat in tight spaces, contact that would otherwise occur between tip 16 and docks, other boats or other objects is avoided because the impact is accepted by the soft pad 40 rather than by the sharp tip 16. Thus, the bumpers 26 prevent the nose cones 14 from being damaged, and they also prevent the sharp tips of the nose cones from causing damage to other boats, docks and other structures.

In addition, each bumper 26 includes a horizontal step 44 which is located conveniently to receive the feet of persons boarding and unboarding the boat. The sturdy manner in which each bumper 26 is mounted allows persons to step on and apply weight to the steps 44 without damaging the pontoons. The cleat 50 permits boarding ladders, anchors and other items of hardware to be attached to one or both of the pontoons 12, and each cleat also provides a convenient tie for ropes and other lines. The location of the bumpers 26 allows them to act as shields which prevent waves from breaking over the forward edge of the boat deck when the boat is traveling in rough water. In addition, the attractive configuration of each bumper 26 and its manner of construction provides the bumpers with the ability to blend in well in appearance with the remainder of the boat. At the same time, the bumpers cover the rather unsightly tip portions of the nose cones and thus improve the overall physical appearance of the pontoon boat.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a pontoon boat having a pair of pontoons terminating in forward ends, the improvement comprising:

a bumper for each pontoon, each bumper having opposite sides and a padded nose piece between said sides at forward ends thereof;

a step surface on each bumper extending between the sides thereof and having a generally horizontal orientation when the bumper is mounted on the pontoon; and means for mounting said bumpers on the respective pontoons at locations in which said nose pieces extend forwardly beyond the forward ends of the pontoons to protect the forward ends of the pontoons from impact, said mounting means comprising a mounting platform secured to the pontoon and elevated above same and means for connecting said step surface to said mounting platform.

2. The improvement of claim 1, wherein:

the boat includes rigid braces for connection of the pontoons thereto; and said mounting means for each bumper further includes means for connecting at least one of said sides to said braces.

3. The improvement of claim 1, wherein the opposite sides of each bumper includes:

a pair of substantially parallel side portions having forward ends; and a pair of converging side portions extending from said forward ends of the respective parallel side portions and converging at said nose piece.

4. The improvement of claim 1, wherein the nose piece of each bumper comprises:

a rigid nose element connected to each side of the bumper and having an exposed surface; and a soft pad on said surface.

5. In a pontoon boat having a body, a plurality of rigid braces and a pair of pontoons which terminate in noses projecting forwardly beyond the body and which are secured to the braces, the improvement comprising:

a bumper mounted on each pontoon, each bumper having opposite sides extending generally along the pontoon and a padded nose piece connected between the sides and projecting forwardly beyond the nose of the pontoon to protect the nose from impact, at least one side of each bumper being rigidly secured to said braces; and a generally horizontal step surface on each bumper extendint between the sides thereof and having a size and shape to serve as a step.

6. The improvement of claim 5, including a mounting platform secured to each pontoon, said step surfaces of the bumpers being mounted on and secured to the respective mounting platforms.

7. The improvement of claim 5, wherein the nose piece of each bumper comprises:

a rigid nose element connected to each side of the bumper and having an exposed surface; and a soft pad on said surface.

8. In a pontoon boat having a pair of pontoons which each terminate in a forward end presenting a tapered nose and a plurality of rigid braces to which the pontoons are secured, the improvement comprising:

a bumper secured on each pontoon, each bumper having opposite sides extending along the pontoon and a nose piece connected between the sides at a location adjacent the nose of the pontoon, at least one side of each bumper being rigidly secured to said braces;

a soft pad on each nose piece for protecting the nose of the pontoon from impact; and a generally horizontal step surface on each bumper spanning the sides thereof.

9. The improvement of claim 8, including a mounting platform secured to each pontoon, said step surfaces of the bumpers being mounted on and secured to the respective mouting platforms.

10. In a pontoon boat having a body and a pair of pontoons terminating in forward ends which extend beyond the body, the improvement comprising:

a bumper for each pontoon, each bumper having opposite sides and a nose piece located between said sides at the forward ends thereof a generally flat step surface on eahc bumper having a sufficient length and width to serve as a step for persons boarding the boat and departing therefrom; and means for mounting said bumpers on top of the respective pontoons at locations in which portions of said bumpers extend beyond the respective pontoons to protect preselected portions of the pontoons from impact, said mounting means being effective to locate said step surfaces on top of the respective pontoons in a horizontal orientation for service as a step for persons boarding the boat and departing therefrom.

11. In a pontoon boat having a body and a pair of pontoons which terminate in noses projecting forwardly beyond the body, the improvement comprising:

a bumper mounted on top of the nose of each pontoon at a location to protect preselected portions thereof from impact, each bumper having opposite sides; and a generally flat step surface on each bumper extending between the sides thereof above the pontoon and having a substantially horizontal orientation and a size and shape to serve as a step thereby facilitating the boarding of and departure from said boat.

12. In a pontoon boat having a pair of pontoons terminating in forward ends, the improvement comprising:

a bumper for each pontoon, each bumper having opposite sides and a nose piece between said sides at forward ends thereof, each side including a pair of substantially parallel side portions having forward ends and a pair of converging side portions extending from said forward ends of the respective parallel side portions and converging at said nose piece; and means for mounting said bumpers on the respective pontoons at locations in which said nose pieces extend forwardly beyond the forward ends of the pontoons to protect the forward ends of the pontoons from impacts.

* * * * *